United States Patent [19]

Nattrass

[11] Patent Number: 4,646,357

[45] Date of Patent: Feb. 24, 1987

[54] TRANSPORT BAG FOR PARTICULATE MATERIAL

[75] Inventor: Peter J. Nattrass, Barrington Hills, Ill.

[73] Assignee: Bulk Lift International, Incorporated, Carpentersville, Ill.

[21] Appl. No.: 710,481

[22] Filed: Mar. 11, 1985

[51] Int. Cl.[4] ..... B65D 33/14; B65D 33/36; B65D 88/16; B65D 88/54

[52] U.S. Cl. ..... 383/20; 383/6; 383/41; 383/107; 383/121; 383/904; 383/906; 222/105; 222/181

[58] Field of Search ..... 383/6, 7, 17, 18, 20, 383/22, 24, 41, 107, 119, 904, 906, 121, 125, 117; 222/105, 181, 185, 507

[56] References Cited

U.S. PATENT DOCUMENTS

| | | | |
|---|---|---|---|
| 4,010,784 | 3/1977 | Nattrass et al. | 383/24 X |
| 4,207,937 | 6/1980 | Sandeman et al. | 383/24 X |
| 4,307,764 | 12/1981 | Nattrass | 383/17 |
| 4,362,199 | 12/1982 | Futerman | 383/17 |
| 4,364,424 | 12/1982 | Nattrass | 383/24 |
| 4,417,659 | 11/1983 | Hatchell | 383/107 X |
| 4,479,243 | 10/1984 | Derby et al. | 383/24 |
| 4,493,109 | 1/1985 | Nattrass | 383/24 X |

FOREIGN PATENT DOCUMENTS

| | | | |
|---|---|---|---|
| 76101 | 9/1976 | Australia | 383/22 |
| 1696 | 5/1979 | European Pat. Off. | 383/17 |
| 2824940 | 12/1979 | Fed. Rep. of Germany | 383/24 |
| 1159515 | 7/1969 | United Kingdom | 383/20 |
| 737312 | 6/1980 | U.S.S.R. | 383/6 |

*Primary Examiner*—William Price
*Assistant Examiner*—Sue A. Weaver
*Attorney, Agent, or Firm*—Mathew R. P. Perrone, Jr.

[57] ABSTRACT

A fabric bag for carrying bulk materials is formed by attaching side panels into a U-shaped member such that the bag is generally in the shape of a rectangular solid in the open position. Lifting loops are secured to each corner of the bag. A discharge outlet is present in the base of the bag for simplifying the emptying process for the bag. The lifting loops are present and sufficiently strong to support the bag when the bag is lifted by a forklift or similar apparatus.

20 Claims, 8 Drawing Figures

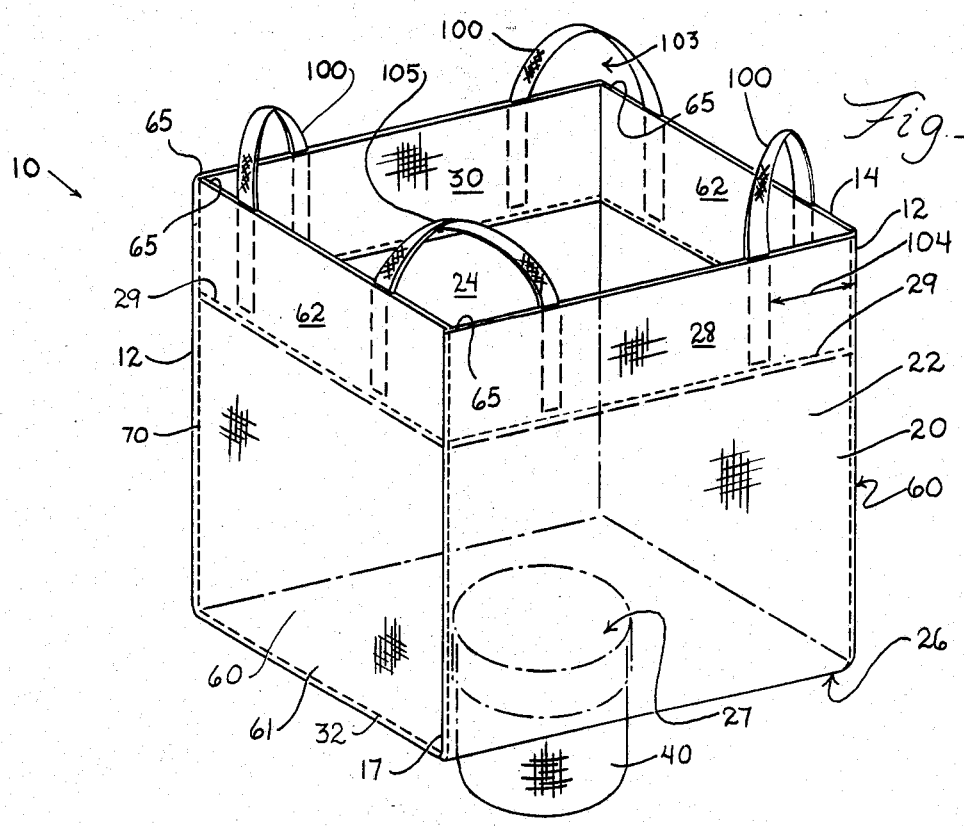
Fig. I
Fig. II
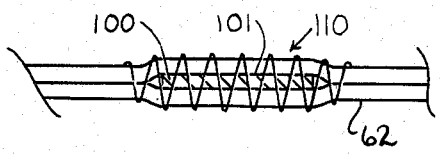
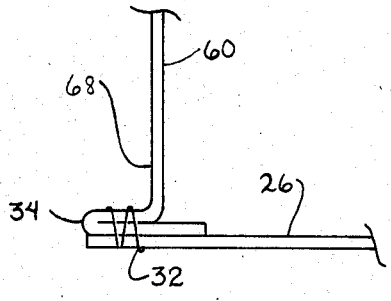
Fig. III
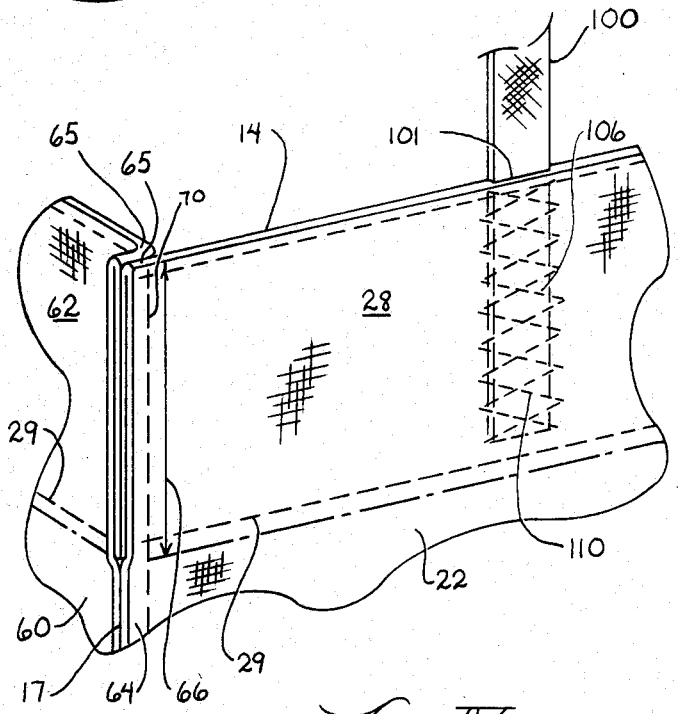
Fig. IV

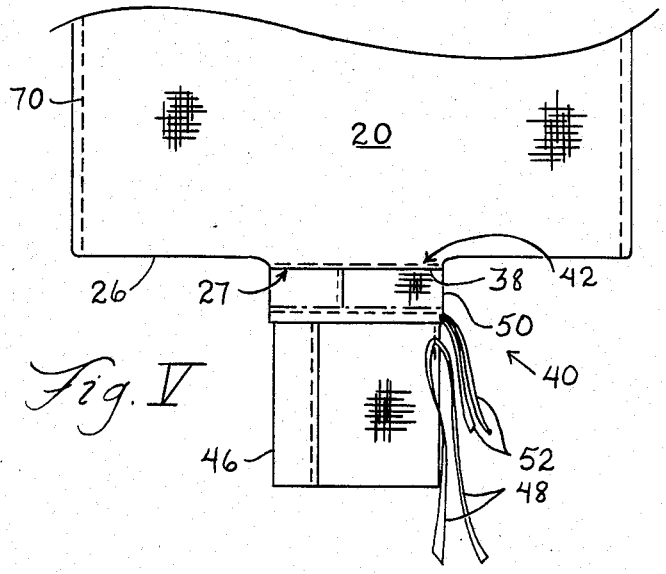
Fig. V
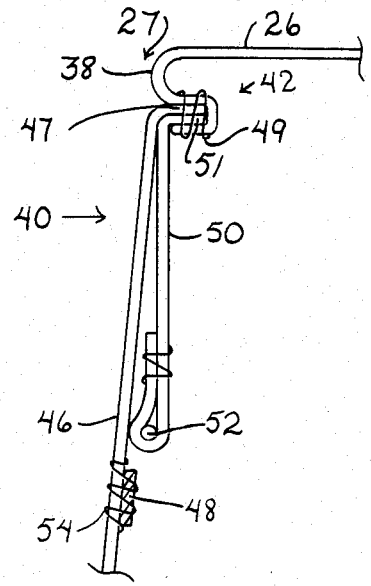
Fig. VI
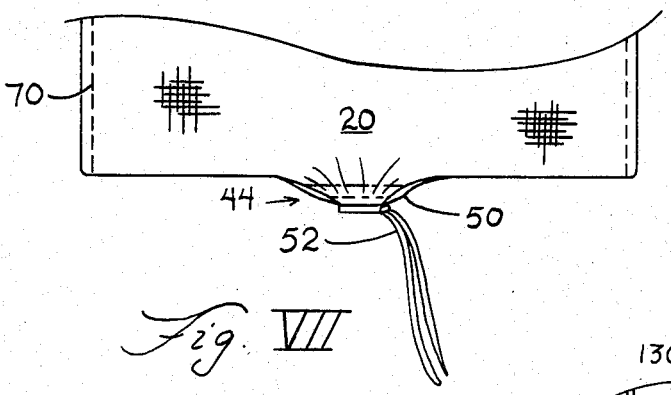
Fig. VII
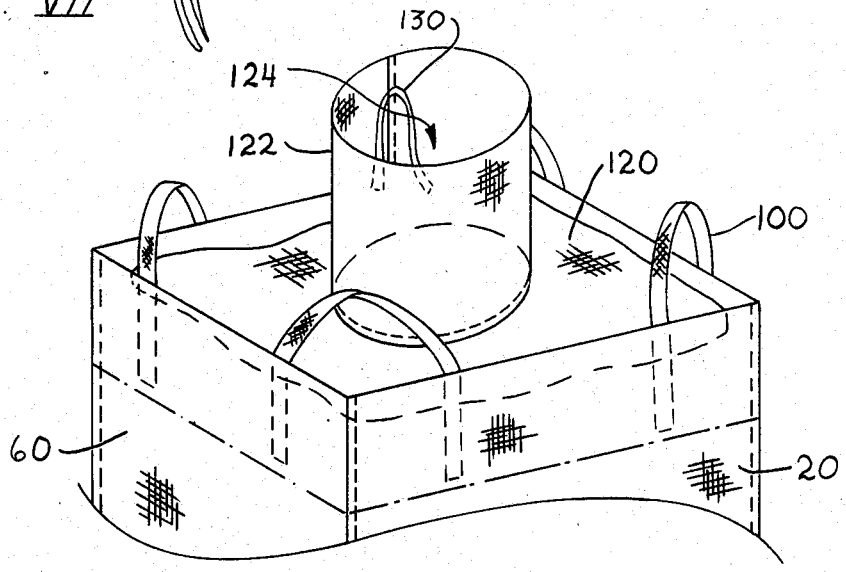
Fig. VIII

TRANSPORT BAG FOR PARTICULATE MATERIAL

BACKGROUND OF THE INVENTION

This invention relates to large fabric bags for transporting bulk quantities of particulate material and more particularly to bags containing particulate material which can be lifted by mechanical equipment having hooks or tines.

The advantages of large fabric bags for the carrying particulate material are clear. These bags are easily stored after the material has been emptied from the bags. These bags also provide for flexible handling of the bag until it is desired to fill the bags with the material to be transported. It is very critical that the bag be sufficiently strong to hold substantial amount of material. It is common for such bags to hold in excess of 1000 kilograms.

The name inventor of this application is the inventor or coinventor of a number of other patents in this field. His experience in this field causes his company to be a highly recognized leader in the field of bulk material handling.

Several different types of bags are known to the applicant herein. These bags involve use of certain types of material and special seams for the bags to provide the desired strength. These special seams are relatively complicated to manufacture and require a substantial amount of material to achieve the strength. It is desirable to make more efficient use of the material while maintaining the strength of the bag. It is also desirable to have the bag open enough to be filled easily and emptied easily.

Typically, the bags are desired to be of uniform square or rectangular horizontal cross-section. Of course, the square cross-section, according to geometric principles, provides the most area and volume for the amount of material used.

Generally, bags are required to be made of expensive, heavy-duty material to achieve desired strength. The fabric used for these bags is required to have a weight of at least eight ounces per square yard (271 grams per square meter) and a tensile strength of at least 400 pounds per square inch (28.2 kilograms per square centimeter). Such a strong fabric is required to make a bag of sufficient strength.

The bags of the prior art also require two people to load the bag onto the fork lift or other lifting apparatus. One person threads the loops onto the fork or hooks, while the other operates the lifting apparatus.

If a bag to carry bulk material can be manufactured more simply, and can use both less and inexpensive material while being easily handled by a forklift or similar apparatus can be developed; great advantages can be achieved.

SUMMARY OF THE INVENTION

Therefore, it is an object of the present invention to provide a bag capable of transporting bulk particulate material.

It is also an object of this invention to provide a bag having a top section with the same cross section as the bottom section.

A still further object of this invention is to provide a bag for bulk materials having lifting loops securely anchored adjacent a corner section of the bag in order to provide maximum strength and durability.

Yet a further object of this invention is to provide a bag for bulk material which has a generally consistent rectangular cross section throughout its height.

Also an object of this invention is to provide a bag for bulk material using a minimum amount of fabric.

Another object of this invention is to provide a bag for bulk material made from less strong material while maintaining the bag strength.

Yet another object of this invention is to provide a bag for bulk material which can be lifted by the operator of a lifting apparatus without assistance from another person.

These and other objects of the invention (which other objects become completely clear by considering the specifications, claims and drawings as a whole) are met by providing a bag made of three pieces of material stitched together. In the bag is a top hem or top fold longer than a lifting loop attachment joint to hold the lifting loops in place. Each of the lifting loops are secured in the top hem or top fold at a distance from, but adjacent to, the corner seam of the bag.

BRIEF DESCRIPTION OF DRAWING

FIG. I is a perspective view of the bag 10 of this invention.

FIG. II is a top view of handle 100 in partial cross section showing lifting loop attachment joint 110.

FIG. III is a top view in partial cross section of side seam 32.

FIG. IV is a partial section view of lifting loop attachment joint 110, hem stitches 29, and lifting loop attachment 110 at a corner 12 of bag 10.

FIG. V is a partial section of bag 10 showing bottom discharge outlet 40

FIG. VI is a partial section view of discharge outlet seam 42 of bottom discharge outlet 40.

FIG. VII is a partial section view of FIG. V showing discharge outlet 40 in closed position 44.

FIG. VIII is a partial section view of the top 14 of bag 10 with cover 120 inserted therein.

Throughout the Figures of the drawing, where the same part appears in more than one Figure of the drawing, the same number is applied thereto.

DESCRIPTION OF THE PREFERRED EMBODIMENTS

A fabric bag for carrying bulk materials is formed by attaching side panels into a U-shaped member such that the bag is generally in the shape of a rectangular solid in the open position. Lifting loops are secured to each corner of the bag. A discharge outlet is present in the base of the bag for simplifying the emptying process for the bag. The lifting loops are present and sufficiently strong to support the bag when the bag is lifted by a forklift or similar apparatus.

Referring now to FIG. I, bag 10 is shown in perspective view with U-shaped fabric 20 having side panels 60 sewn therein. U-shaped fabric 20 is generally in three sections having a first side section 22 and a second side section 24 with a discharge outlet section 26 therebetween. U-shaped fabric 20 is generally of one piece with the sides being designed for the purposes of completing the rectangular solid.

U-shaped fabric 20 has, in first side section 22, a first hem section 28. Hem section 28 is formed by folding over a piece of U-shaped fabric 20 and stitching a hem therein to form hem section 28. Hem section 28 may also be referred to as a fold section. Hem section 28 must be of an appropriate length to provide lifting loop strength. In a like manner, second side section 24 has a second hem section 30. Both first hem section 28 and second hem section 30 are oppositely disposed from discharge outlet section 26, and held in place by hem stitches 29. Hem stitches 29 are formed in a standard fashion.

Referring now to FIG. II and FIG. IV, the structure of side panel 60 and lifting loop 100 is seen more clearly. A pair of side panels 60 are used to complete the bag 10. Side panel 60 includes a side hem section 62 formed in substantially the same way as first hem section 28 and second hem section 30. Hem section 62 combines with first hem section 28, second hem section 30, and hem stitches 29. By first hem section 28, second hem section 30, or side hem section 62 is meant a fold in the fabric used make bag 10. By hem stitches 29 is meant stitching to secure the fold or hem section in position. Side panel 60 has, oppositely disposed from side hem section 62 a side panel bottom 61.

Side hem section 62, first hem section 28, and second hem section 30 are formed prior to the joining of side panel 60 to U-shaped section 20. The side hem section 62 of each of side panels 60 is joined adjacent the hem seam of the first hem section 28 and second hem section 30 by bag seam 70. The fabrics thus joined are simply stitched at bag seam 70 together down the side to form a side selvage 64 at each edge 17 of bag 10. This side selvage 64 results in the leaving of a sufficient amount of material to provide strength for the bag 10. Bag seam 32 joins side panel bottom 61 to discharge section 26. Bag seam 32 and side seam 70 combine to form a very simple seam to join a pair of side panels 60 oppositely disposed from each other in U-shaped fabric 20, which provides strength without the complicated seam workups of other bags.

Side selvage 64 is generally up to five (5%) percent of the width 65 of the bag 10. More preferably, side selvage is up to four (4%) percent of the width of the bag 10. Most preferably, side selvage is up to three (3%) percent of the width of the bag 10.

Referring now to FIG. 1, FIG. IV and FIG. VIII, lifting loop 100 is stitched into side hem section 62, and in the adjoining first hem section 28 or second hem section 30 as desired through lifting loop slots 101. Lifting loop end 106 of lifting loop 100 is inserted through lifting loop slot 101, so that lifting loop 100 is between the parts of side hem section 62, and first hem section 28 or second hem section 30—and protrudes above bag 10. Lifting loop 100 is of sufficient strength to hold the weight of the bag 10 and the contents. In fact, the bag 10 can hold up to seven times the weight it is normally required to hold—thereby providing for a safety factor of up to seven. Generally speaking, the safety factor is about five.

Lifting loop attachment joint 110 holds lifting loop 100 in the bag 10 adjacent to the corners 12. Preferably, lifting loop 100 is cross stitched to form lifting loop attachment joint 110 at a distance 104 from the corner 12 wherein distance 104 equals up to about forty five percent of the width of the bag 10. More preferably, distance 104 is five to forty percent of the width of the bag 10. Most preferably, distance 104 is ten to thirty percent of the width of the bag 10.

Lifting loop 100, also preferably includes a twist 105. This twist 105 is formed by rotating lifting loop end 106, 180° about the longitudinal axis relative to the oppositely disposed lifting loop end 106. Each of the lifting loop ends 106 may then be stitched in position.

With this spacing of lifting loop 100 through lifting loop slots 101 and twist 105, lifting loop 100 stands upright and can be reached by a fork lift driver or tine truck driver without assistance. Even if loop 100 is not made of stiffened material to stand up, this result is achieved due to the spacing.

Additionally, lifting loop end 106 reaches from the top 14 of bag 10 up to about ninety (90%) percent down the hem width 66. More preferably, lifting loop end 106 reaches about ten to about eighty five (10% to 85%) percent the width of the hem. Most preferably, lifting loop end 106 reaches fifty to eighty five (50% to 85%) percent of the hem width 66. This spacing from the hem has proven to be a great factor in the strengthening of bag 10 and lifting loop 100.

Referring now to FIG. III, side seam 32 of bag 10 is shown in partial cross section. Side seam 32 connects discharge outlet section 26 to the side panel bottom 68. Side seam 32 is an overlap 34 formed in side panel 60 and stitched in standard fashion to discharge outlet section 26. This relatively simple stitch provides great strength.

Referring now to FIG. V, a close up view of discharge outlet 40 is shown as partial section of the bag 10. Chute 40 includes an interior guide 46 with an interior tie 48. Interior guide 46 is generally folded inside of bag 10 and tied in place. Outer guide 50 is then tied with outer tie 52 to hold interior guide 46 in place within bag 10.

Referring now to FIG. VI, the structure of discharge outlet 40 is shown. Outer guide 50 of discharge outlet 40 is shown with outer tie 52 in cross section. Lower guide 46 is shown with interior tie 48 secured thereto with tie stitches 54. Outer guide 50 is generally a piece added to discharge outlet section 26 at a discharge outlet aperture 27, while interior guide 46 is also an additional piece stitched thereto. Interior guide stitching 49 is shown in a double overlap bonding with discharge outlet 26, adjacent to the central portion 38 of discharge outlet section 26. This overlap bonding shows the interior discharge outlet stitched above the outer guide. Central portion 38 is a folded section with outer tube top 51 of outer guide 50 and lower tube top 47 of interior guide 46 secured therebetween by stitching. Lower tube top 47 is secured therein above outer tube top 51. In this fashion, great strength is achieved.

FIG. VII depicts bottom discharge outlet 40 in the outer closed position 44.

FIG. VIII depicts cover 120 in position on bag 10. Basically cover 120 is fitted over bag 10 in a tight fitting capacity with a single discharge outlet 122 centrally located within cover 120. Cover discharge outlet 122 is centrally stitched into cover 120 and protects an cover opening 124 within cover 120. Cover discharge outlet 122 may be secured in a closed position similar to closed position 44 with cover tie 130. In this fashion, the bag 10 can be covered in a simple manner and adequate results are obtained.

Any suitable material may be used to manufacture the bags of this invention. The big advantage of the structure of the bags of these inventions is that while heavier duty material may be used, material having a weight of up to six ounces per square yard (215 grams per square meter) and a tensile strength of up to 300 pounds per square inch (22 kilograms per square centimeter) is operable. The lifting loop material must of course be of sufficient strength to hold without tearing the weight put in the bag. The lifting loop material may be made of stiffen material to have the loop stand up. However, due to the design of the lifting loop structure, it is not necessary to use stiffened material.

Because of the disclosure herein and solely because of the disclosure herein, certain modifications hereof can become apparent to those having ordinary skill in this art. Such modifications are clearly covered hereby.

What is claimed and sought to be secured by Letters Patent of the United States is:

1. A bulk material transport bag including a U-shaped member, a pair of oppositely disposed side panels secured to said U-shaped member to provide said bag with a horizontal rectangular cross section having four corners, and a lifting loop secured adjacent to each corner of said bag, wherein:

a. said U-shaped member has a first side section and a second side section, and a discharge outlet section between said first side section and said second side section;

b. a first side fold section is secured in said first side section and a second side fold section is secured in said second side section—with said first side fold section and said second side fold section being oppositely disposed from said discharge outlet section;

c. a side panel fold section is secured in each of said pair of side panels;

d. said first side fold section, said second side fold section and said side panel fold sections are substantially similar and form a top of said bag;

e. a pair of lifting loop slots is in each of said first side fold section, said second side fold section and said side panel fold sections—each of said slots being adjacent to a corner;

f. said lifting loop is secured at each lifting loop end thereof through a pair of said lifting loop slots adjacent to each of said four corners of said bag at said top to provide four of said lifting loops; and g. each lifting loop is secured at each lifting loop end thereof through an adjoining pair of said lifting loop slots with a lifting section of each of said lifting loops exposed above said top.

2. The bulk material transport bag of claim 1 wherein said oppositely disposed side panels are stitched to said U-shaped member to leave a side selvage to provide strength for said bulk material transport bag.

3. The bulk material transport bag of claim 2 wherein said bag has a safety factor of up to about seven.

4. The bulk material transport bag of claim 3 wherein said lifting loop is held in position by cross stitching.

5. The bulk material transport bag of claim 4 wherein said cross stitching holds said lifting loop end of said lifting loop in said bag a distance equal to up to about forty five percent of a width of said bag, said width being measured from one of said corners to an adjacent one of said corners.

6. The bulk material transport bag of claim 5 wherein said distance is five to forty percent of said width of said bag.

7. The bulk material transport bag of claim 6 wherein said distance is ten to thirty percent of said width of said bag.

8. The bulk material transport bag of claim 7 wherein said discharge outlet section includes a discharge outlet to simplify an emptying process for said bag.

9. The bulk material transport bag of claim 8 wherein said first side fold section, said second side fold section, and each of said side panel fold sections are substantially equal in a panel width and are oppositely disposed from said discharge outlet section.

10. The bulk material transport bag of claim 9 wherein all of said fold sections are substantially identical.

11. The bulk material transport bag of claim 10 wherein said side panel fold section of each of said side panels is joined adjacent said first side fold section and said second side fold section.

12. The bulk material transport bag of claim 11 wherein each of said side selvage includes up to about five percent of a width said bulk material transport bag.

13. The bulk material transport bag of claim 12 wherein each of said side selvage is up to about three (3%) percent of said width.

14. The bulk material transport bag of claim 13 wherein said lifting loop end reaches from a top of said bag up to about ninety percent down said side fold section.

15. The bulk material transport bag of claim 14 wherein said lifting loop end reaches fifty to eighty five percent of said side fold section and each of said lifting loops includes a twist.

16. The bulk material transport bag of claim 15 wherein:

a. said discharge outlet includes a chute;

b. said chute includes an interior guide with an interior tie for closing and holding said interior guide in a folded fashion on an outside or an inside of said bag; and c. said chute includes an outer guide with an outer tie for closing and holding said outer guide in a folded fashion on an outside or an inside of said bag.

17. The bulk material transport bag of claim 16 wherein:

a. said discharge outlet includes said outer guide as a first piece of material added to said discharge outlet section at a discharge aperture centrally located in said discharge outlet section;

b. said discharge outlet includes said interior guide as a second piece of material added to said discharge outlet section at said discharge aperture centrally located in said discharge outlet section;

c. said interior guide is secured at said discharge aperture above said outer guide;

d. said discharge outlet includes said outer guide and said interior guide secured to said discharge outlet section between a fold at said discharge outlet aperture;

e. a cover protects a top of said bag and is fitted over said bag in a tight fitting capacity; and f. a single discharge outlet is centrally located within said cover.

18. The bulk material transport bag of claim 17 wherein fabric used to make said bag has a tensile strength of up to about 22 Kilograms per square centimeter and a weight of up to about 215 grams per square meter.

19. A bulk material transport bag including a U-shaped member, a pair of oppositely disposed side panels secured to said U-shaped member to provide said bag with a horizontal rectangular cross section having four corners, and a lifting loop secured adjacent to each corner of said bag, wherein:

a. said U-shaped member has a first side section and a second side section, and a discharge outlet section between said first side section and said second side section;

b. a first side fold section is secured in said first side section and a second side fold section is secured in said second side section—with said first side fold section and said second side fold section being oppositely disposed from said discharge outlet section;

c. a side panel fold section is secured in each of said pair of side panels;

d. said first side fold section, said second side fold section and said side panel fold sections are substantially similar and form a top of said bag;

e. a pair of lifting loop slots is in each of said first side fold section, said second side fold section and said side panel fold sections—each of said slots being adjacent to a corner;

f. said lifting loop is secured at each lifting loop end thereof through a pair of said lifting loop slots adjacent to each of said four corners of said bag at said top to provide four of said lifting loops;

g. each of said lifting loops is secured at each lifting loop end thereof through an adjoining pair of said lifting loop slots with a lifting section of each of said lifting loops exposed above said top;

h. said oppositely disposed side panels are joined by a simple seam to said U-shaped member to leave a side selvage of up to about three percent of a width of said bulk material transport bag in order to provide strength therefor;

i. said bulk material transport bag has a safety factor of about five;

j. each of said lifting loop ends is held in said bag at a distance from said corner by cross stitching;

k. said cross stitching holds said lifting loop end of said lifting loop in said bag at said distance, said distance being equal to about ten to about thirty percent of a width of said bag, said width being measured from one of said corners to an adjacent one of said corners;

l. all of said fold sections are substantially identical;

m. each of said lifting loop ends extends from a top of said bag down each of said fold sections for loop attachment distance about fifty to eighty five percent of a width of said fold section; and n. each of said lifting loops has a twist therein.

20. The bulk material transport bag of claim 19 wherein: said discharge outlet section includes a a. discharge outlet with an outer guide as a first piece of material added to said discharge outlet section at a discharge aperture centrally located in said discharge outlet section;

b. said discharge outlet includes an interior guide as a second piece of material added to said discharge outlet section at said discharge aperture;

c. said interior guide is secured at said discharge aperture above said outer guide;

d. said discharge outlet includes said outer guide and said interior guide secured to said discharge outlet section between a fold at said discharge outlet aperture;

e. a cover protects a top of said bag and is fitted over said bag in a tight fitting capacity; and f. a single discharge outlet is centrally located within said cover.

* * * * *